US005090585A

United States Patent [19]

Power

[11] Patent Number: 5,090,585

[45] Date of Patent: Feb. 25, 1992

[54] GARBAGE CONTAINER APPARATUS

[76] Inventor: Elbert N. Power, 18920 Liggett St., Northridge, Calif. 91324

[21] Appl. No.: 668,092

[22] Filed: Mar. 12, 1991

[51] Int. Cl.[5] ..... B65F 1/06

[52] U.S. Cl. ..... 220/404; 220/908; 248/99

[58] Field of Search ..... 220/404, 908; 248/95, 248/99

[56] References Cited

U.S. PATENT DOCUMENTS

| | | | |
|---|---|---|---|
| 2,025,932 | 12/1935 | Beldin | 220/404 |
| 2,678,764 | 5/1954 | Carlson | 248/99 |
| 3,757,990 | 9/1973 | Buth | 220/404 |
| 3,814,359 | 6/1974 | Powell | 248/99 |
| 4,235,350 | 11/1980 | Valentino | 220/404 |
| 4,268,392 | 5/1981 | Hayes | 220/404 |
| 4,535,911 | 8/1985 | Goulter | 220/404 |
| 4,756,445 | 7/1988 | Agee, Sr. | 220/404 |
| 4,834,262 | 5/1989 | Reed | 220/404 |
| 4,913,308 | 4/1990 | Culbertson | 220/404 |
| 4,932,557 | 6/1990 | Yeo | 220/404 |

*Primary Examiner*—Stephen Marcus
*Assistant Examiner*—S. Castellano
*Attorney, Agent, or Firm*—Leon Gilden

[57] ABSTRACT

An apparatus wherein a container includes an annular skirt defining a channel between an upper terminal end of an associated container and the skirt, wherein mounted plug members are positioned for insertion into the skirt to arrest an upper terminal end portion of a flexible bag liner. Side walls of the container include removable plugs to prevent trapped air between the liner and an interior wall of the container. Modifications of the invention include a magazine storage cavity positioned underlying an upper floor of the container, with a magazine container within for selective removal of liners therefrom for securement to an interior surface of the associated container.

2 Claims, 5 Drawing Sheets

GARBAGE CONTAINER APPARATUS

BACKGROUND OF THE INVENTION

1. Field of the Invention

The field of invention relates to garbage container apparatus, and more particularly pertains to a new and improved garbage container apparatus wherein the same is arranged for the ease of mounting and securement of a polymeric type film garbage can liner within an associated container.

2. Description of the Prior Art

Various garbage can liner apparatus has been set forth in the prior art for mounting within a circular garbage can. Particularly in the use of such liner apparatus, air pockets are developed between the liner and interior surface of the circular container hampering proper positioning of the liner within the container. The instant invention attempts to overcome such deficiencies of the prior art by providing removable plug members preventing formation of such air pockets. Examples of the prior art include U.S. Pat. No. 4,723,740 to Courtemanch, et al. wherein a liner includes mounting hooks within the container for securement of the liner within the apparatus.

U.S. Pat. No. 4,735,240 to Preston sets forth a garbage container and associated bracketry mounted to an upper terminal end of the container for securement of the liner relative to the container.

U.S. Pat. No. 3,664,623 to Vaccar sets forth a container apparatus utilizing a compartment positioned medially of the container for storage of and for use as a magazine for mounting additional liners for subsequent use.

U.S. Pat. No. 4,235,350 to Valentino sets forth a container apparatus for mounting to a bed post, wherein the apparatus positions liners therewithin in a conventional manner.

As such, it may be appreciated that there continues to be a need for a new and improved garbage container apparatus as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of garbage container apparatus now present in the prior art, the present invention provides a garbage container apparatus wherein the same provides for a prevention of air pockets formed between a polymeric film-type liner mounted within a garbage container and further provides additional securement members for positioning of the liner relative to an upper terminal edge of the container. As such, the general purpose of the present invention, which will be described subsequently in greater detail, is to provide a new and improved garbage container apparatus which has all the advantages of the prior art gargage container apparatus and none of the disadvantages.

To attain this, the present invention provides an apparatus wherein a container includes an annular skirt defining a channel between an upper terminal end of an associated container and the skirt, wherein mounted plug members are positioned for insertion into the skirt to arrest an upper terminal end portion of a flexible bag liner. Side walls of the container include removable plugs to prevent trapped air between the liner and an interior wall of the container. Modifications of the invention include a magazine storage cavity positioned underlying an upper floor of the container, with a magazine container within for selective removal of liners therefrom for securement to an interior surface of the associated container.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved garbage container apparatus which has all the advantages of the prior art garbage container apparatus and none of the disadvantages.

It is another object of the present invention to provide a new and improved garbage container apparatus which may be easily and efficiently manufactured and marketed.

It is a further object of the present invention to provide a new and improved garbage container apparatus which is of a durable and reliable construction.

An even further object of the present invention is to provide a new and improved garbage container apparatus which is susceptible of a low cost of manufacture with regard to both materials and labor, and which accordingly is then susceptible of low prices of sale to the consuming public, thereby making such garbage container apparatus economically available to the buying public.

Still yet another object of the present invention is to provide a new and improved garbage container apparatus which provides in the apparatuses and methods of the prior art some of the advantages thereof, while simultaneously overcoming some of the disadvantages normally associated therewith.

Still another object of the present invention is to provide a new and improved garbage container apparatus wherein the same utilizes a magazine supply operatively mounted through a floor of the container for presenting subsequent liners for use in the lining of an associated garbage container.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
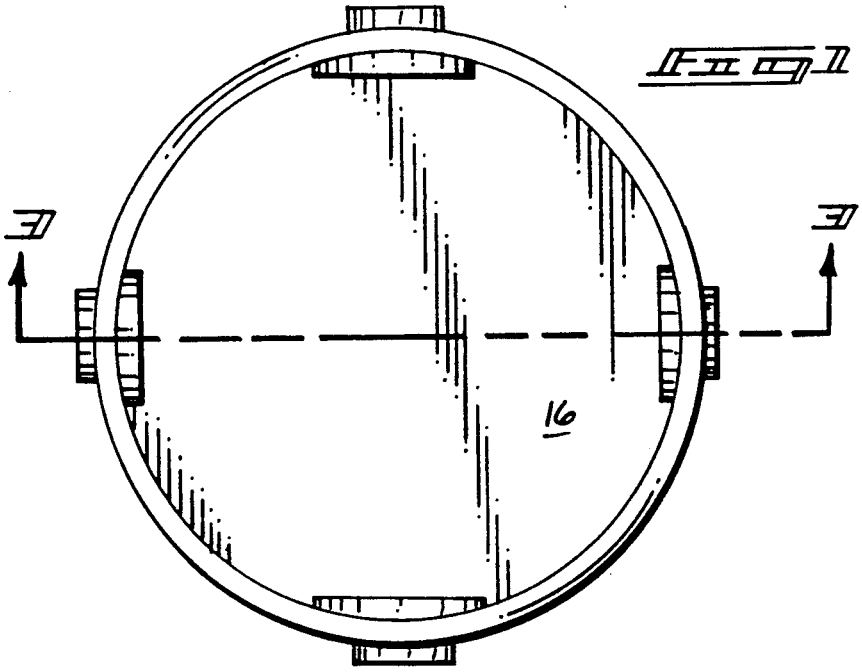
FIG. 1 is a top orthographic view of the instant invention.
Figure 2:
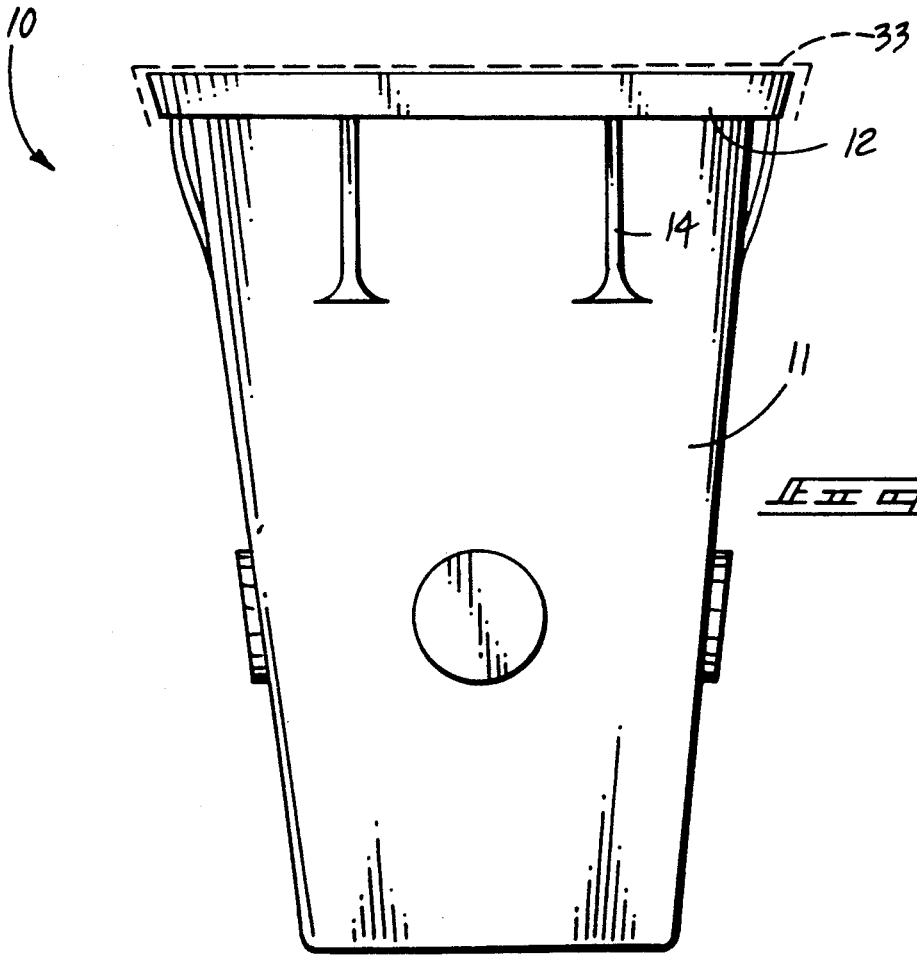
FIG 2 is an orthographic side view, taken in elevation, of the instant invention.
Figure 3:
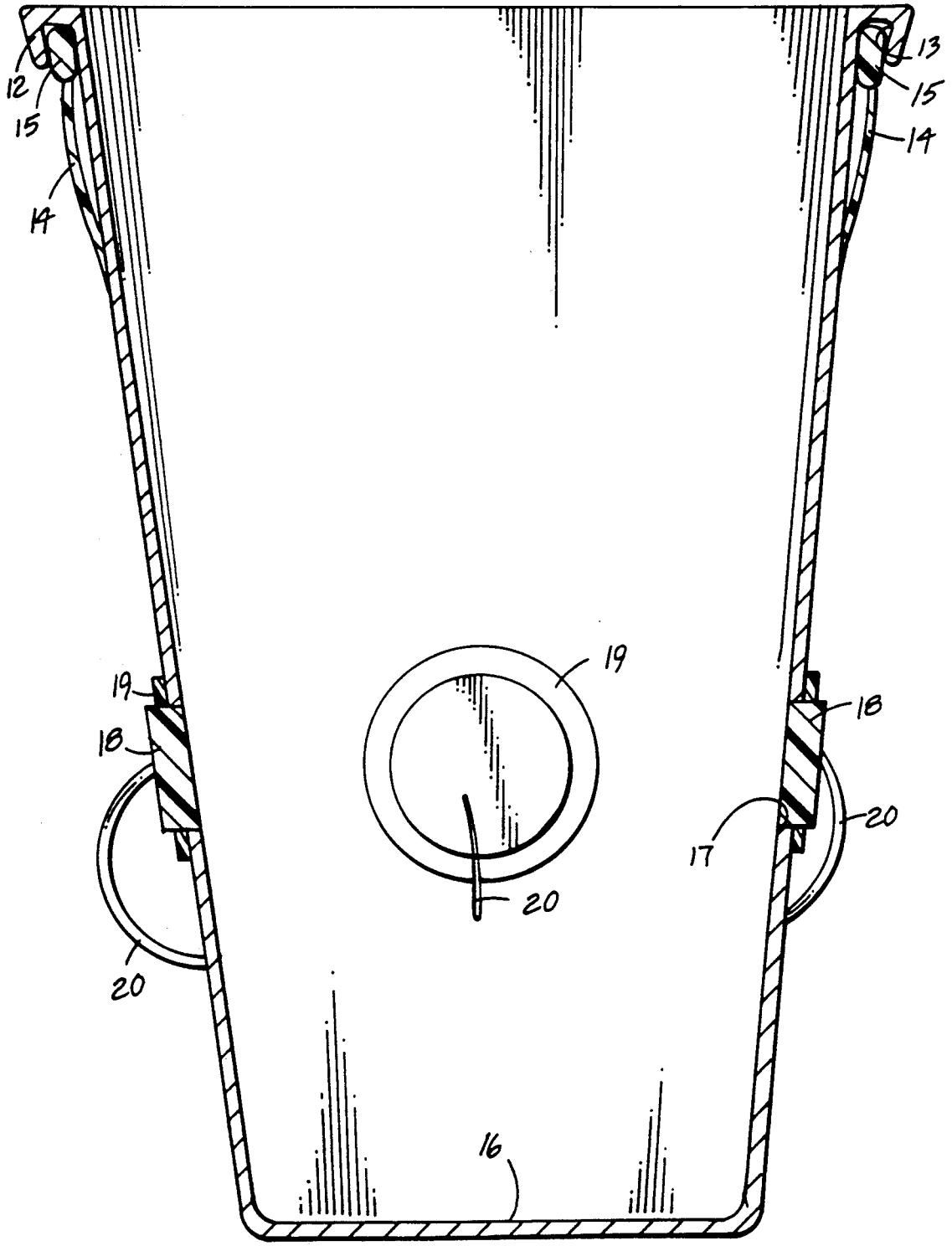
FIG. 3 is an orthographic cross-sectional illustration of the instant invention.

With reference now to the drawings, and in particular to FIGS. 1 to 7 thereof, a new and improved garbage container apparatus embodying the principles and concepts of the present invention and generally designated by the reference numeral 10 will be described.

More specifically, the garbage container apparatus 10 of the instant invention essentially comprises an elongate container defined by a truncated, conical side wall 11 coaxially aligned, including a truncated, conical skirt 12 formed to an upper terminal end of the side wall 11 defining an annular channel 13 defined by a predetermined width between the side wall 11 and the skirt 12. A plurality of strap members 14 are spaced about the exterior surface of the side wall 11, whose lower terminal ends are integrally mounted to an exterior surface of the side wall 11 and whose upper terminal ends each include an integrally mounted plug head 15 whose thickness is substantially equal to the predetermined width of the channel 13. A container floor 16 is orthogonally oriented relative to an axis defined by the side wall 11.

A plurality of equally spaced circumferentially positioned wall apertures 17 are directed through the side wall 11 somewhat medially of the side wall 11 defined by a predetermined diameter. Each of the wall apertures 17 includes a plug member 18 whose external diameter is equal to the predetermined diameter removably mounted within an associated aperture. Each of plug members 18 includes a plug member annular disk 19 mounted to the plug member and coaxially aligned therewith defined by a further diameter greater than the predetermined diameter to prevent directing of a plug member interiorly of the associated side wall 11. Each of the plug members 11 includes a tether line 20 mounted from the plug member to the side wall 11 preventing inadvertent loss or displacement of an associated plug member relative to an associated aperture In use, a liner is mounted within the container with the plug members removed therefrom to permit air trapped between a typical polymeric film-type liner and an interior surface of the container to escape. Further, an upper terminal edge of the liner is directed within the channel 13, wherein the plug heads 15 are subsequently directed into the channel to capture and arrest the upper terminal edge portion of the liner within the channel, in a manner as illustrated in FIG. 4 for example.

Figure 4:
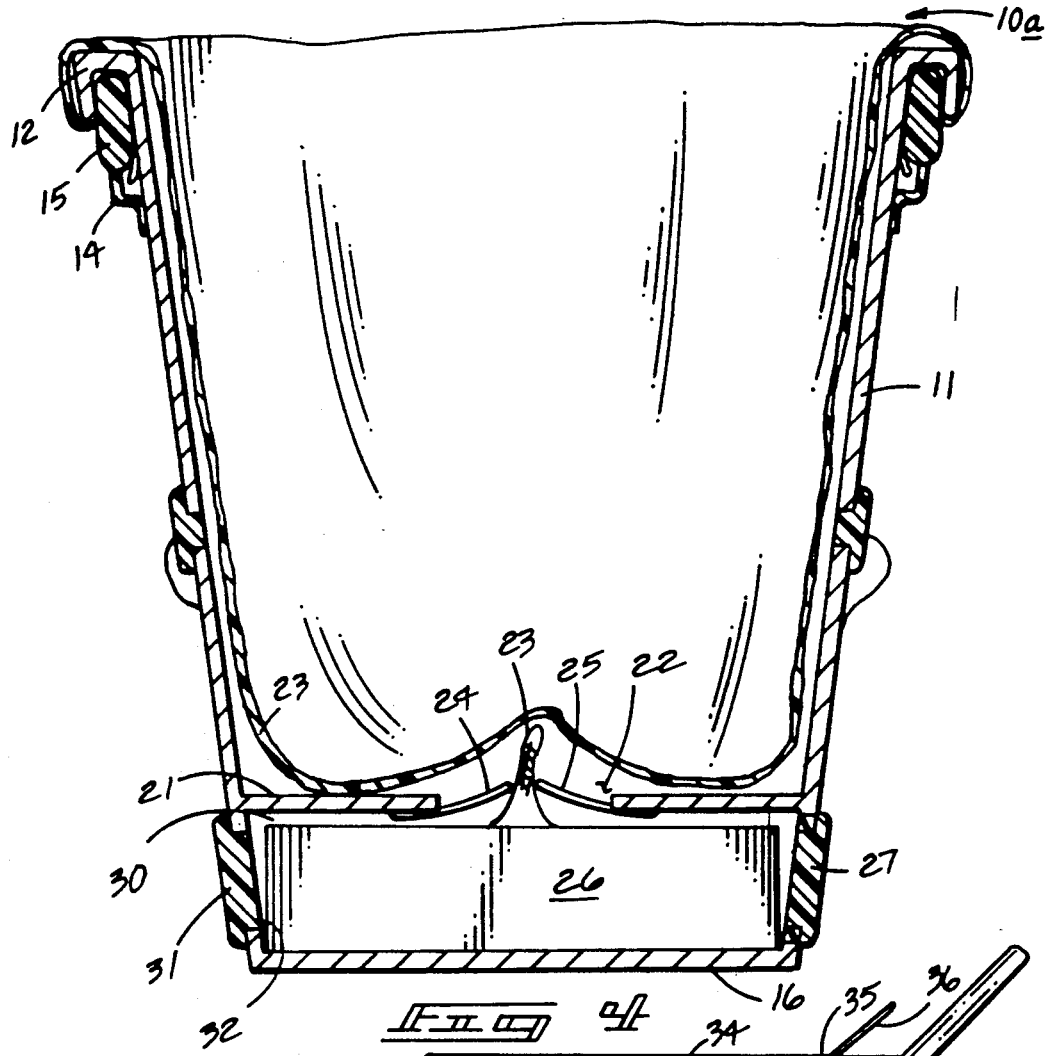
FIG. 4 is an orthographic cross-sectional illustration of a modification of the instant invention.

FIG. 4 illustrates a modified container apparatus wherein a slotted top floor 21 is positioned parallel to and spaced above the container floor 16 to define a magazine storage cavity 30 therebetween. The slotted top floor 21 includes a slot 22 directed thereacross as illustrated, wherein the slot includes a respective first and second resilient flap 24 and 25 mounted on opposed sides of the slot permitting frictional displacement of a flexible polymeric-type container liner 23 therethrough. The flap, subsequent to removal of a liner, returned to an original position preventing undesirable debris from entering the cavity 30. A liner magazine housing 26 storing a plurality of such container liners 23 is positioned within the cavity 30 through a door 27 that includes a hinge 28 mounted to a left side of the door and a handle 29 mounted to an exterior of the door adjacent a right side edge of the door permitting insertion and subsequent removal of magazine housing 26 from within the cavity 30. A storage cavity plug member 31 is directed into the cavity 30 through the side wall 11 received within a cavity aperture 32 diametrically opposed to the door 27 to permit an individual to insert various objects through the aperture 32 to enhance displacement and removal of a housing 26 subsequent to its depletion of liners 23 therefrom.

It should be noted that a lid 33 (see FIG. 2) is optionally provided, wherein the lid 33 is formed with an interior lid cavity complementary to that to receive the skirt 12 therewithin.

Figure 5:
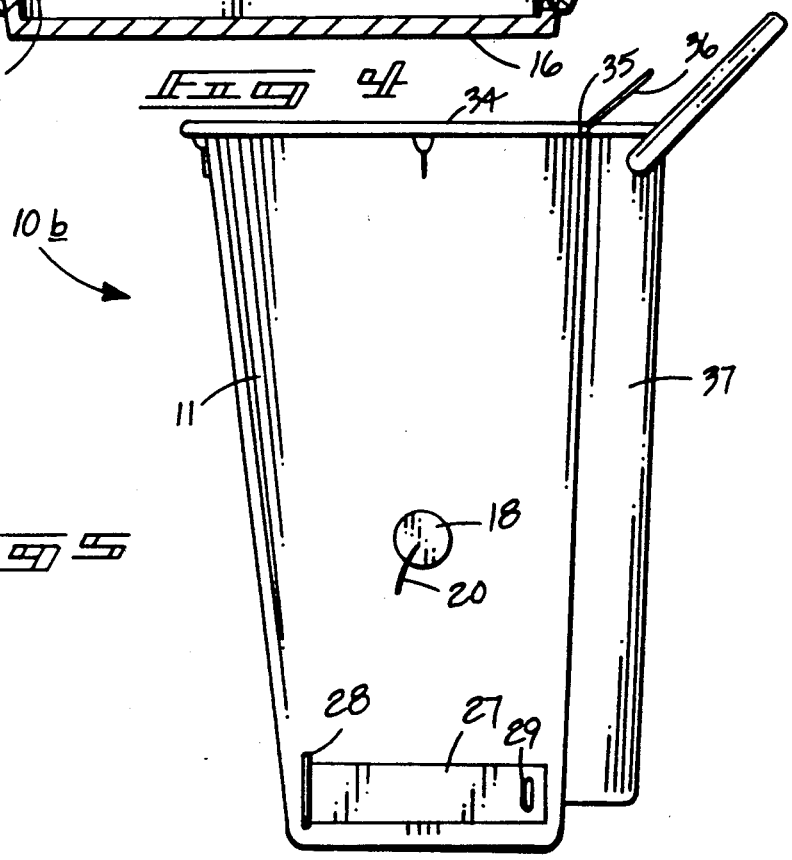
FIG. 5 is an orthographic side view, taken in elevation, of a further modification of the instant invention.
Figure 6:
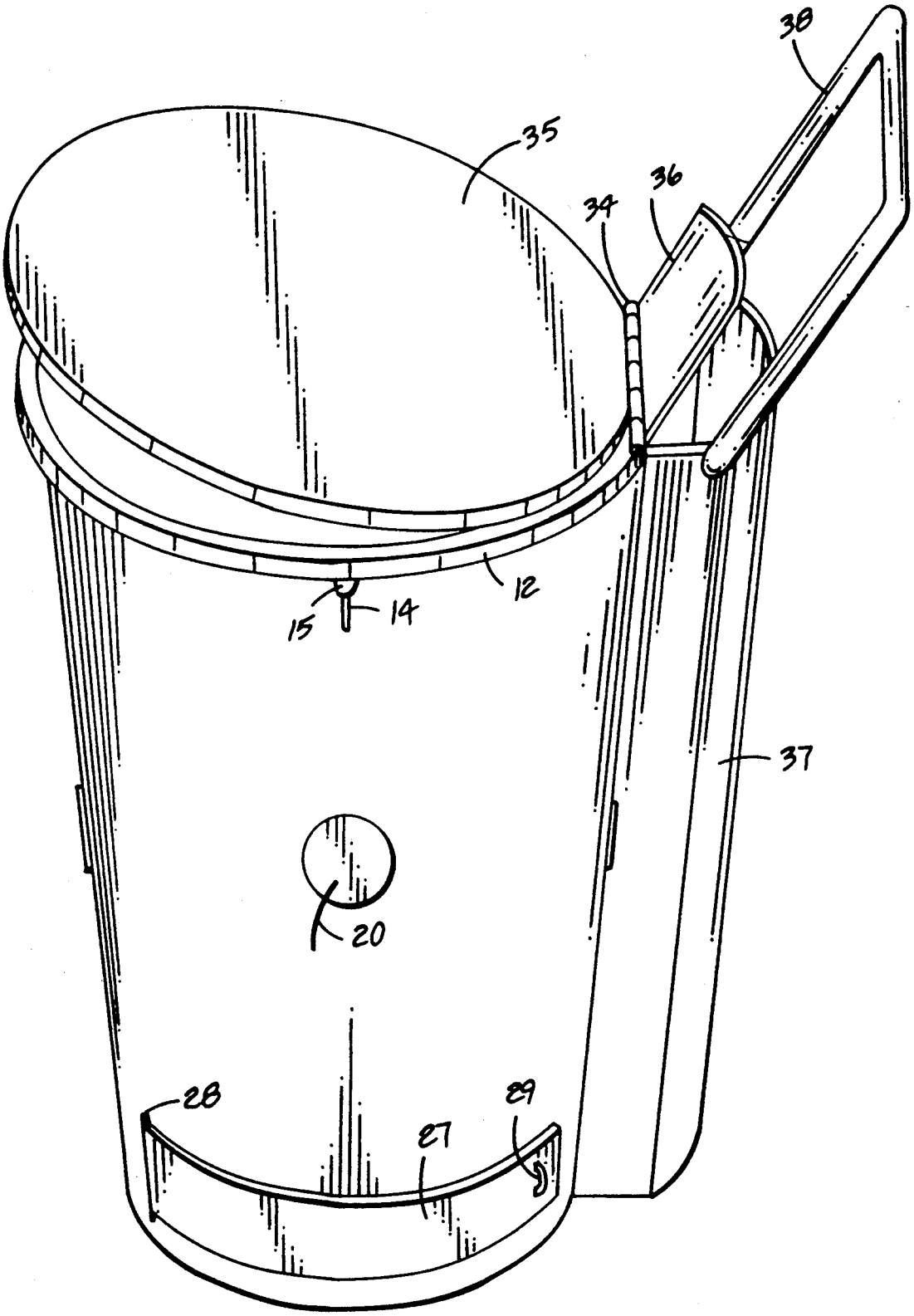
FIG. 6 is an isometric illustration of the further modified aspect of the invention.
Figure 7:
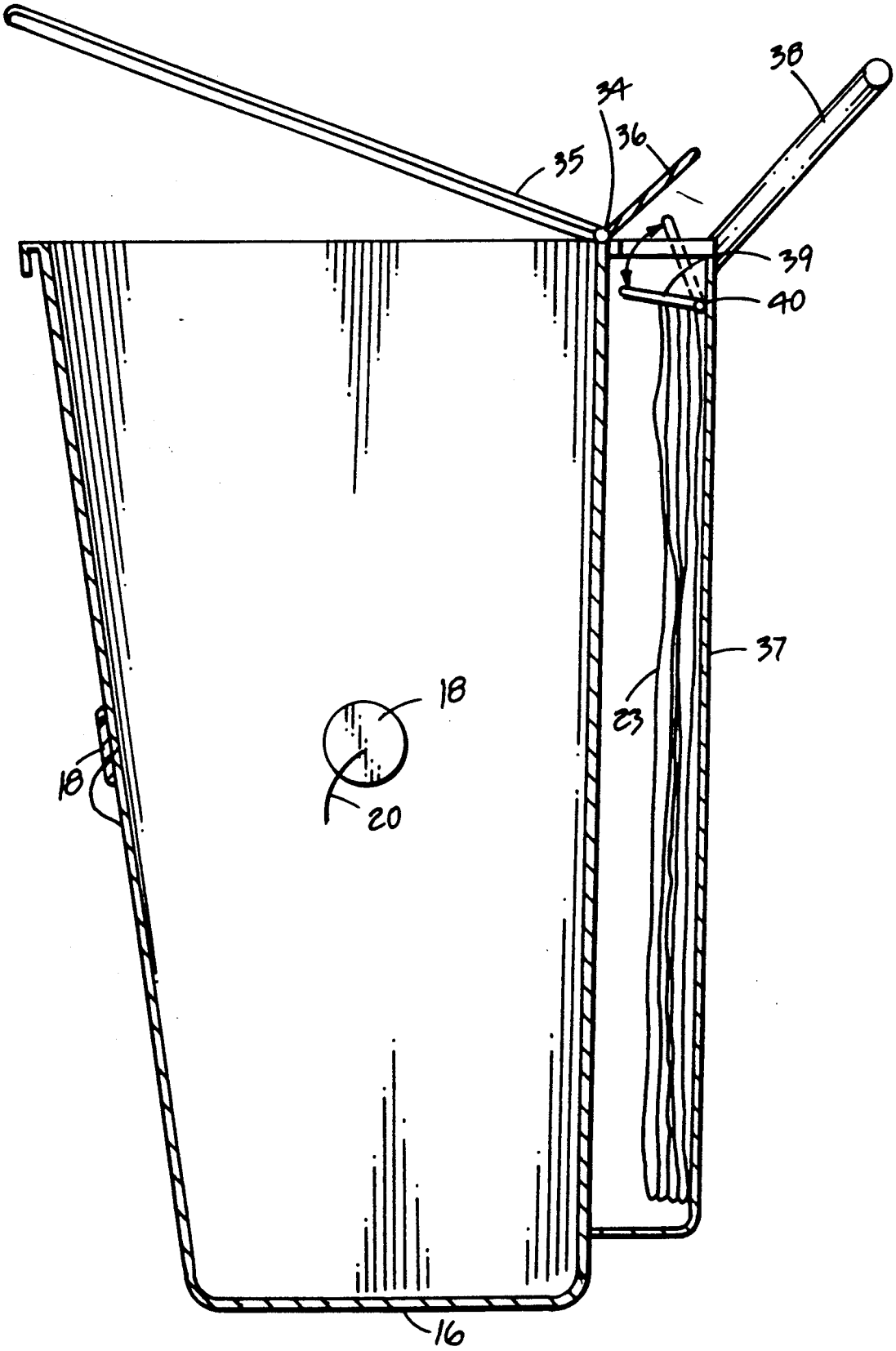
FIG. 7 is an orthographic cross-sectional illustration of the further modified organization utilized by the instant invention.

FIGS. 5–7 illustrate the use of a further modified apparatus **10*b*, wherein a first lid 34 and a second lid 36 are commonly mounted to a medially positioned lid hinge 35. The lid hinge 35 is mounted at a junction defined by the upper terminal edge of the side wall container 11 and a storage housing 37 positioned adjacent and in contiguous communication with the side wall 11. The storage housing includes a handle 38 mounted thereto for ease of manipulation of the organization for transport thereof. An abutment plate 39 is positioned within the storage housing 37 below an upper terminal edge thereof, wherein a spring hinge 40 normally biases the abutment plate 39 in a horizontal orientation, as illustrated in FIG. 7 for example, to maintain a supply of container liners 23** therewithin.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A garbage container apparatus comprising, in combination, a container member, including a longitudinal axis and an elongate side wall, circumferentially aligned with said axis, the side wall including an upper terminal edge, with the side wall including an "L" shaped skirt mounted orthogonally to the upper terminal edge defining an annular channel between the skirt and the side wall, the annular channel containing a width spaced from the side wall defined by a predetermined width, and a plurality of plug heads equally spaced relative to one another and mounted within the annular channel, wherein each of the plug heads is defined by a thickness equal to the predetermined width, and the container member including a container floor orthogonally aligned relative to said axis, and the side wall further including a plurality of equally spaced wall apertures directed through the side wall circumferentially oriented relative to one another defining a common circle whose center is coincident with the axis, each of the apertures defined by a predetermined diameter, and a plug member removably mounted within each of the apertures, each plug member defined by an external diameter substantially equal to the predetermined diameter, and each plug member including a coaxially aligned annular flange, and a tether line mounted fixedly to each plug member, and wherein each tether line is further mounted to the side wall.

2. An apparatus as set forth in claim 1 which includes a strap member mounted to each of the plug heads, and each of the strap members includes a lower terminal edge, wherein each lower terminal edge is integrally mounted to the side wall below the annular channel.

* * * * *